US009915265B2

(12) United States Patent
Peters

(10) Patent No.: US 9,915,265 B2
(45) Date of Patent: Mar. 13, 2018

(54) COMPRESSOR SYSTEM WITH VARIABLE LUBRICANT INJECTION ORIFICE

(71) Applicant: Ingersoll-Rand Company, Davidson, NC (US)

(72) Inventor: Michael Peters, Mooresville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 114 days.

(21) Appl. No.: 14/962,705

(22) Filed: Dec. 8, 2015

(65) Prior Publication Data

US 2016/0186755 A1 Jun. 30, 2016

Related U.S. Application Data

(60) Provisional application No. 62/098,906, filed on Dec. 31, 2014.

(51) Int. Cl.

| | |
|---|---|
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 29/02*** | (2006.01) |
| ***F04C 18/16*** | (2006.01) |
| ***F04B 39/02*** | (2006.01) |
| ***F04D 29/063*** | (2006.01) |
| *F04C 23/00* | (2006.01) |

(52) U.S. Cl.

CPC ..... *F04C 29/021* (2013.01); *F04B 39/02* (2013.01); *F04C 18/16* (2013.01); *F04C 29/028* (2013.01); *F04D 29/063* (2013.01); *F04C 23/008* (2013.01); *Y10S 418/01* (2013.01)

(58) Field of Classification Search

CPC ..... F04C 18/16; F04C 23/008; F04C 29/02; F04C 29/021; F04C 29/026; F04C 29/028; Y10S 418/01; F04B 39/02; F04D 29/063

USPC ..... 418/84, 87, 97, 99, 100, 201.1, 270, 418/DIG. 1

See application file for complete search history.

(56) References Cited

U.S. PATENT DOCUMENTS

| | | | | |
|---|---|---|---|---|
| 3,429,502 A | | 9/1967 | Lundvik | |
| 3,482,768 A | | 12/1969 | Cirrincione et al. | |
| 4,503,685 A | * | 3/1985 | DiCarlo | F04B 39/16 62/193 |
| 5,134,856 A | * | 8/1992 | Pillis | F04C 29/026 418/DIG. 1 |

(Continued)

FOREIGN PATENT DOCUMENTS

| | | |
|---|---|---|
| GB | 2344856 A | 6/2000 |
| JP | H0381589 A | 4/1991 |

OTHER PUBLICATIONS

European Patent Office Partial European Search Report cited in counterpart EP Application No. 15003689.5, dated May 30, 3026 (7 pages).

*Primary Examiner* — Theresa Trieu
(74) *Attorney, Agent, or Firm* — Taft Stettinius & Hollister, LLP

(57) ABSTRACT

A compressor system with a continuously variable oil injection orifice is structured to regulate a flow of oil from an oil reservoir into a compressor. The orifice includes a first valve member moveable in response to oil pressure toward a second valve member to define a continuously variable flow area. A biasing member urges the first valve member away from the second valve member.

21 Claims, 2 Drawing Sheets

(56) References Cited

U.S. PATENT DOCUMENTS

| | | | | |
|---|---|---|---|---|
| 5,411,375 | A | 5/1995 | Bauer | |
| 6,257,837 | B1 | 7/2001 | Adams et al. | |
| 6,439,261 | B1 | 8/2002 | Bush et al. | |
| 7,547,203 | B2 | 6/2009 | Dieterich | |
| 8,070,465 | B2 | 12/2011 | Ginies et al. | |
| 2001/0046443 | A1 | 11/2001 | Van De Putte | |
| 2006/0117790 | A1* | 6/2006 | Dieterich | F04C 18/16 418/201.1 |
| 2008/0279708 | A1 | 11/2008 | Heimonen et al. | |
| 2013/0068322 | A1 | 3/2013 | Köck et al. | |

* cited by examiner

COMPRESSOR SYSTEM WITH VARIABLE LUBRICANT INJECTION ORIFICE

CROSS REFERENCE TO RELATED APPLICATIONS

This application claims the benefit of U.S. Provisional Application No. 62/098,906, filed Dec. 31, 2014, which is incorporated herein by reference in its entirety.

FIELD OF THE INVENTION

The present application relates to compressor systems, and more particularly to compressor systems having a continuously variable orifice for injecting lubricant therein.

BACKGROUND

Compressor systems, such as oil lubricated compressor systems, remain an area of interest. Some existing systems have various shortcomings, drawbacks, and disadvantages relative to certain applications. For example, in some oil flooded compressors, the oil injection orifice may not suitably inject oil at all operating regimes. Accordingly, there remains a need for further contributions in this area of technology.

SUMMARY

Embodiments of the present application include a unique compressor system having a compressor, an oil reservoir and a continuously variable oil injection orifice structured to regulate a flow of oil from the oil reservoir into the compressor. Embodiments of the present application also include a unique compressor system having a screw compressor; an oil reservoir; and a pressure actuated variable oil injection orifice structured to regulate a flow of oil from the oil reservoir into the screw compressor. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
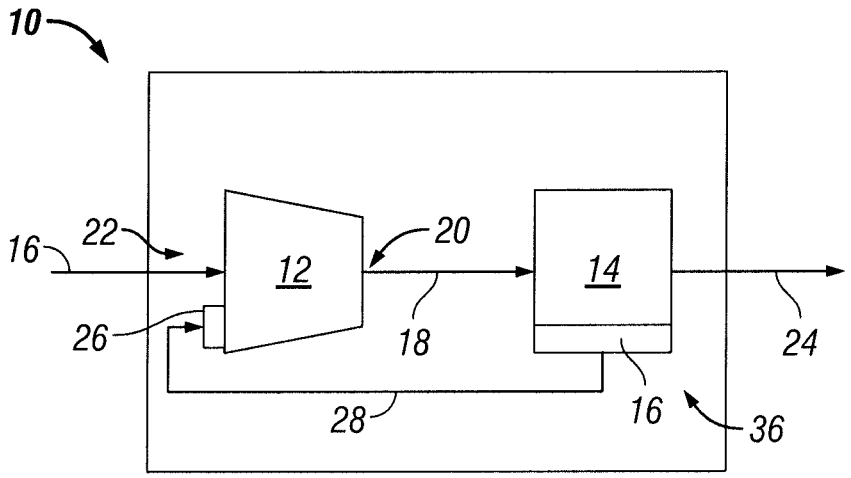
FIG. 1 schematically depicts a compressor system having a continuously variable oil injection orifice in accordance with an exemplary embodiment of the present disclosure.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring now to FIG. 1, some aspects of a nonlimiting example of a compressor system 10 in accordance with some embodiments of the present disclosure are schematically depicted. Compressor system 10 includes a compressor 12 and an oil separation system 14 having an oil reservoir 16. In one form, compressor 12 is a flooded rotary screw compressor. In other embodiments, compressor 12 may take other forms, such as an oil-free screw compressor. In the form of a flooded rotary screw compressor, compressor 12 is operative to receive and compress a gas 16, e.g., air, using oil as a sealing and lubricating agent, and to discharge a compressed two-phase air/oil mixture 18 via a compressor discharge 20. The oil may also be used to lubricate, for example, bearings, gears and seals. In the form of an oil-free screw compressor, compressor 12 receives oil, e.g., for lubricating, e.g., bearings, gears and seals, and discharges the oil, e.g., for subsequent conditioning, such as cooling and/or filtering, and return to compressor 12 for continued lubrication, e.g., of the bearings, gears and seals. In the form of an oil-free screw compressor, an oil separation system may not be used, in which case, oil is supplied to compressor 12 via another lube oil system. It should be understood that the term "oil" as used herein can be any lubricating fluid that includes petroleum carbon-based compositions as well as manmade or synthetic material compositions.

Compressor 12 includes an air inlet 22 for receiving air 16. Oil separation system 14 is in fluid communication with compressor discharge 20. Oil separation system 14 is operative to receive air oil mixture 18, to discharge compressed air 24 that is substantially free of oil, and to accumulate oil that is substantially free of air in an oil reservoir 16 for use by compressor 12.

During normal operation, that is, while compressor 12 operates to compress air or another desired fluid, the return oil is supplied to compressor 12 via an orifice that controls the amount of oil supplied to compressor 12. Although it may be possible to use one or more conventional orifices to control the amount of oil supplied to compressor 12, e.g., one for high pressure operation and one for low pressure operation, such provisions may not provide oil at the most desired flow rate during operation at intermediate pressures.

In addition, where similar compressors 12 are used in a variety of platforms, for example and without limitation, the same or similar compressor used in a platform that operates at 100 psig, a platform that operates at 125 psig and another platform that operates at 145 psig, a plurality of orifices may be required as stock items for the different platforms, and/or the compressors may not be operating under the most desirable oil lubrication conditions. Accordingly, in embodiments of the present invention, compressor system 10 includes a continuously variable oil injection orifice 26 for injecting oil into compressor 12. Continuously variable oil injection orifice 26 is structured to regulate the flow of oil from oil reservoir 16 into compressor 12. Continuously variable oil injection orifice 26 is in fluid communication with oil reservoir 16 via an oil return line 28. The term, "continuously variable," is intended to convey that the effective flow area of continuously variable oil injection orifice 26 may vary continuously between some maximum value and some minimum value, e.g., in response to the pressure of the oil supplied to continuously variable oil injection orifice 26 from oil return line 28, as opposed to a stepwise variation in flow area. In various embodiments, oil return line 28 may be, for example, one or more tubes, pipes, machined or caste passages or the like. In various embodiments, continuously variable oil injection orifice 26 may be installed in and considered a part of compressor 12, or may be external to compressor 12, and may be disposed at any suitable location.

Figure 2:
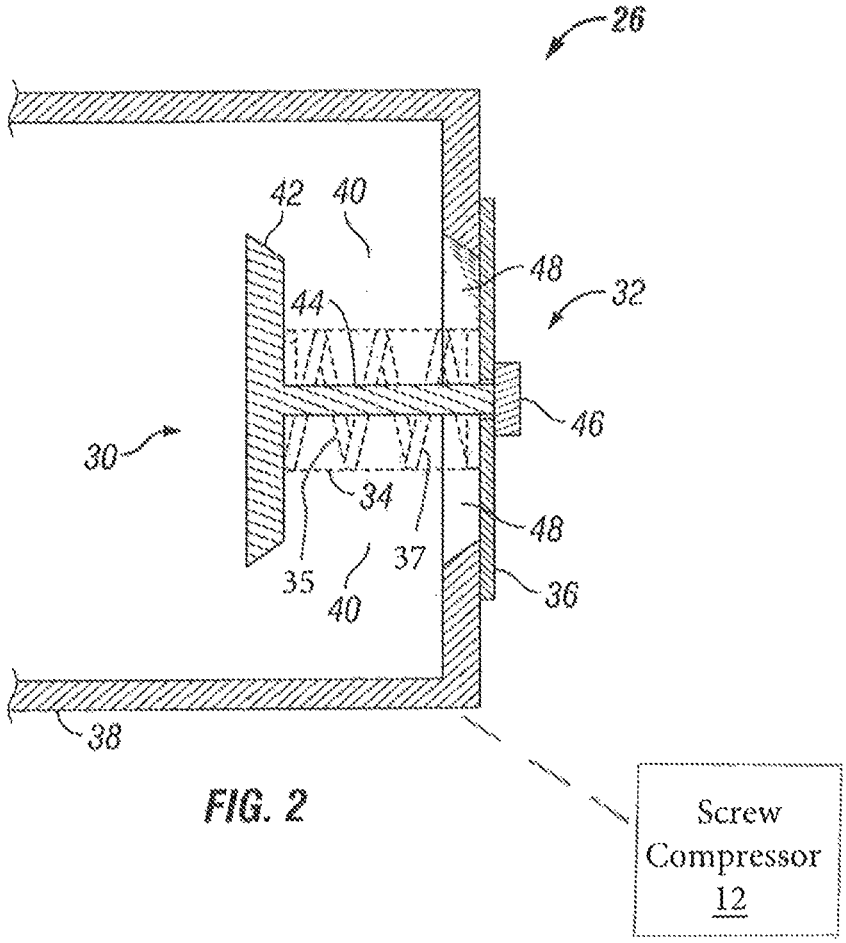
FIG. 2 is a cross-sectional view of a portion of a continuously variable oil injection orifice in accordance with an exemplary embodiment of the present disclosure.
Figure 3:
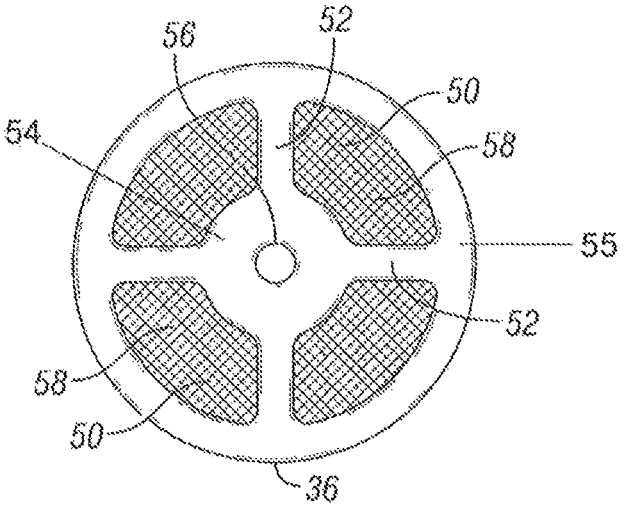
FIG. 3 is an end view of a plate for a continuously variable oil injection orifice in accordance with an exemplary embodiment of the present disclosure.

Referring now to FIGS. 2 and 3, some aspects of non-limiting examples of continuously variable oil injection orifice 26 are illustrated in accordance with embodiments of the present invention. Continuously variable oil injection orifice 26 includes a first valve member 30, a second valve member 32, a bias or biasing member 34 and a plate 36. In one form, valve member 30 and bias member 34 are substantially enclosed within a housing 38 affixed to or installed into compressor 12. In other embodiments, housing 38 may be disposed in another location. In still other embodiments, housing 38 may be integral with compressor 12, e.g., with a component or housing of compressor 12, or may be integral with or installed into another component of compressor system 10. Valve member 30 and valve member 32 are structured to cooperate with each other to define a continuously variable flow area 40, that is, a flow area that may vary continuously from a minimum value to a maximum value, as opposed to a stepwise variation in flow area, for controlling the flow of oil from continuously variable oil injection orifice 26 to compressor 12. Valve member 30 is structured to move in response to oil pressure. In one form, valve member 30 is structured to move towards valve member 32 in response to increasing oil pressure and thus decrease flow area 40. In other embodiments, valve member 30 may be configured to otherwise displace relative to valve member 32. In one form, the valve member 30 is operable to move between a first position defined as fully open to a second position. The second position is defined as a limit position. In some forms the second or limit position can be a fully closed position, however, in other forms the second position is open but defines a reduced flow area 40 relative to the fully open position.

Biasing member 34 is structured to bias valve member 30 relative to valve member 32. In one form, biasing member 34 is structured to bias valve member 30 away from valve member 32. In other embodiments, biasing member 34 may be structured to bias valve member 30 in another direction. In some embodiments, biasing member 34 is structured to have more than one spring rate, e.g., depending upon the amount of deflection of biasing member 34 in response to the incoming oil pressure at continuously variable oil injection orifice 26. In some embodiments, biasing member has one spring rate at a first range of deflection, e.g., for use at low pressures, and a higher spring rate at a second range of deflection, e.g., for use at higher pressures. The higher spring rate manifests upon a predetermined displacement of valve member 30 and consequent deflection of biasing member 34 beyond its initial position, prior to which the lower spring rate is manifested. This allows biasing member 34, and hence continuously variable oil injection orifice 26, to have one operating characteristic at lower pressures and a different operating characteristic at higher pressures. In various embodiments, biasing member 34 may have a plurality of spring rates, or may have a spring rate that varies continuously or stepwise from a minimum value to a maximum value with increasing deflection. In some embodiments, biasing member 34 may be a dual acting spring system having a first spring rate portion 35 and a second spring rate portion 37 that are different from one another. In this manner the biasing member 34 may have a first effective spring rate through a spring deflection (first distance of travel) and a different spring rate through a second deflection distance (second distance of travel) as one skilled in the art would readily understand. In other embodiments, biasing member 34 may be a plurality of springs that are successively engaged with increasing displacement of valve element 30. In one form, biasing member 34 is a compression coil spring. In various embodiments, biasing member may be one or more springs that vary in wire diameter, mean diameter, helix angle or other parameters so as to achieve a desired variable spring rate characteristic.

Valve member 30 includes a head 42 that is acted upon oil pressure supplied to continuously variable oil injection orifice 26. Head 42 converts the pressure load into a force that acts to displace valve member 30 toward valve member 32 against the bias load of biasing member 34. Extending from head 42 is a rod 44 for supporting and guiding head 42. Rod 44 is slidably received into valve member 32. Valve member 30 is retained in engagement with valve member 32 via a flange 46. Valve member 32 includes a port 48. In one form, continuously variable flow area 40 is defined between head 42 and port 48. In other embodiments, port 48 may take other forms, and/or continuously variable flow area 40 may be defined between head 42 and one or more other features of valve member 32.

In one form, plate 36 can include one or more openings 50 defined between an inner hub 54 and an outer rim 55. One or more supporting arms 52 can extend between the hub 54 and the rim 55 to provide structural support for the plate 36 and to define partitions between the openings 50. Plate 36 includes a pilot opening 56 in hub 54 for slidably receiving rod 44. Pilot opening 56 is sized to prevent flange 46 from passing therethrough. In one form, openings 50 define the discharge openings of continuously variable oil injection orifice 26 for discharging oil to compressor 12. In some embodiments, a mesh 58 is disposed in each of openings 50. In some embodiments, mesh 58 may be configured to function as a filter for oil entering compressor 12.

Embodiments of the present invention include a compressor system, comprising: a compressor; an oil reservoir; and a continuously variable oil injection orifice structured to regulate a flow of oil from the oil reservoir into the compressor, the continuously variable oil injection orifice comprising: a first valve member structured to displace in response to oil pressure; a second valve member structured to cooperate with the first valve member to define a continuously variable flow area for controlling a flow of oil through the continuously variable injection orifice; a biasing member structured to urge the first valve member away from the second valve member; and wherein oil pressure acting on the first valve member urges the valve member to move toward the second valve member.

In a refinement, a displacement of the first valve member toward the second valve member reduces the continuously variable flow area.

In another refinement, the biasing member is a dual acting spring system.

In yet another refinement, the second valve member includes a plate having an oil discharge opening for discharging the oil to the compressor.

In still another refinement, the plate includes a mesh disposed in the oil discharge opening.

In still another refinement, the plate includes a hub having a pilot opening formed therethrough; an outer rim positioned about the hub; and at least one supporting arm extending between the hub and the rim.

In yet still another refinement, the pilot opening is structured to slidably receive a rod.

In yet still another refinement, the first valve member includes a head acted upon by oil pressure.

In a further refinement, the first valve member is displaced relative to the second valve member as a function of a change in oil pressure acting on the head.

In a further refinement, the second valve member includes a port, and the continuously variable flow area is defined between the head and the port.

In a further refinement, the rod extending from the head and is slidably coupled with the second valve member.

In a yet further refinement, the continuously variable oil injection orifice includes a rod structured to align the head with the port.

In a still further refinement, the first valve member includes a rod extending from the head and slidably received into the second valve member.

In a yet still further refinement, the second valve member includes a plate having a pilot opening structured to slidably receive the rod.

In another refinement, the plate includes at least one oil discharge opening for discharging oil to the compressor.

Embodiments of the present invention include a compressor system, comprising: a screw compressor; an oil reservoir; and a pressure actuated variable oil injection orifice structured to regulate a flow of oil from the oil reservoir into the screw compressor, the pressure actuated variable oil injection orifice including a first valve member; a second valve member and a biasing member, wherein the first valve member is slidably engaged with the second valve member and biased relative to the second valve member by the biasing member; and wherein the first valve member, the second valve member and the biasing member cooperate to define a continuously variable flow area that decreases with increasing oil pressure for discharging oil to the screw compressor.

In a refinement, the biasing member is structured to have a first spring rate at a first deflection and a second spring rate at a second deflection, wherein the second spring rate is different than the first spring rate.

In another refinement, the biasing member is a dual acting spring.

In yet another refinement, the first valve member includes a head acted upon by oil pressure to displace the first valve member relative to the second valve member.

In still another refinement, the second valve member includes a port, and the continuously variable flow area is defined between the head and the port.

In yet still another refinement, the first valve member includes a rod extending from the head and configured to slidably engage with the second valve member.

In a further refinement, the second valve member includes a plate having a pilot opening structured to slidably receive the rod.

In a yet further refinement, the plate includes at least one oil discharge opening for discharging oil to the screw compressor.

Embodiments of the present invention include a compressor system, comprising: a compressor; an oil reservoir; and means for continuously varying a flow area for controlling a flow of oil from the oil reservoir to the compressor, such that the flow area is reduced as oil pressure is increased up to a predefined limit position.

In further refinements the means includes a valve biased to an open position; the means includes a valve head configured to urge the valve toward a closed position when a flow of oil passes through the valve; the means includes a plate comprising: a hub with a pilot opening formed therethrough; an outer rim positioned radially outward of the hub; and at least one supporting arm extending between the hub and the rim; wherein the plate includes an opening formed between the hub and the outer rim for discharging the oil to the compressor; and wherein the opening includes a mesh disposed therein.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A compressor system, comprising:

a compressor;

an oil reservoir; and a continuously variable oil injection orifice structured to regulate a flow of oil from the oil reservoir into the compressor, the continuously variable oil injection orifice comprising:

a first valve member structured to displace in response to oil pressure;

a second valve member structured to cooperate with the first valve member to define a continuously variable flow area for controlling a flow of oil through the continuously variable injection orifice;

a biasing member structured to urge the first valve member away from the second valve member;

wherein oil pressure acting on the first valve member urges the first valve member to move toward the second valve member; and wherein the biasing member is a dual acting spring system with different spring rates.

2. The compressor system of claim 1, wherein a displacement of the first valve member toward the second valve member reduces the continuously variable flow area.

3. The compressor system of claim 1, wherein the second valve member includes a plate having an oil discharge opening for discharging the oil to the compressor.

4. The compressor system of claim 3, wherein the plate includes a mesh disposed in the oil discharge opening.

5. The compressor system of claim 3, wherein the plate includes:

a hub having a pilot opening formed therethrough;

an outer rim positioned about the hub; and at least one supporting arm extending between the hub and the rim.

6. The compressor system of claim 5, wherein the pilot opening is structured to slidably receive a rod.

7. The compressor system of claim 1, wherein the first valve member includes a head acted upon by oil pressure.

8. The compressor system of claim 7, wherein the first valve member is displaced relative to the second valve member as a function of a change in oil pressure acting on the head.

9. The compressor system of claim 7, wherein the second valve member includes a port, and wherein the continuously variable flow area is defined between the head and the port.

10. The compressor system of claim 7, further comprising a rod extending from the head and slidably coupled with the second valve member.

11. A compressor system, comprising:

a screw compressor;

an oil reservoir; and a pressure actuated variable oil injection orifice structured to regulate a flow of oil from the oil reservoir into the screw compressor, the pressure actuated variable oil injection orifice including a first valve member; a second valve member and a biasing member, wherein the first valve member is slidably engaged with the second valve member and biased relative to the second valve member by the biasing member; wherein the first valve member, the second valve member and the biasing member cooperate to define a continuously variable flow area that decreases with increasing oil pressure; and wherein the first valve member includes a rod extending from the head configured to slidably engage with the second valve member and the second valve member includes a plate having a pilot opening structured to slidably receive the rod.

12. The compressor system of claim 11, wherein the biasing member is structured to have a first spring rate at a first deflection and a second spring rate at a second deflection, wherein the second spring rate is different than the first spring rate.

13. The compressor system of claim 11, wherein the first valve member includes a head acted upon by oil pressure to displace the first valve member relative to the second valve member.

14. The compressor system of claim 13, wherein the second valve member includes a port, and wherein the continuously variable flow area is defined between the head and the port.

15. The compressor system of claim 11, wherein the plate includes at least one oil discharge opening for discharging oil to the screw compressor.

16. A compressor system, comprising:

a compressor;

an oil reservoir; and means for continuously varying a flow area for controlling a flow of oil from the oil reservoir to the compressor, such that the flow area is reduced as oil pressure is increased up to a predefined limit position; and wherein the means includes a plate comprising:

a hub with a pilot opening formed therethrough;

an outer rim positioned radially outward of the hub; and at least one supporting arm extending between the hub and the rim.

17. The compressor system of claim 16, wherein the means includes a valve biased to an open position.

18. The compressor system of claim 16, wherein the means includes a valve head configured to urge the valve toward a closed position when a flow of oil passes through the valve.

19. The compressor system of claim 16, wherein the plate includes an opening formed between the hub and the outer rim for discharging the oil to the compressor.

20. The compressor system of claim 19, wherein the opening includes a mesh disposed therein.

21. A compressor system, comprising:

a compressor;

an oil reservoir; and a continuously variable oil injection orifice structured to regulate a flow of oil from the oil reservoir into the compressor, the continuously variable oil injection orifice comprising:

a first valve member structured to displace in response to oil pressure;

a second valve member structured to cooperate with the first valve member to define a continuously variable flow area for controlling a flow of oil through the continuously variable injection orifice;

a biasing member structured to urge the first valve member away from the second valve member;

wherein oil pressure acting on the first valve member urges the first valve member to move toward the second valve member;

wherein the second valve member includes a plate having an oil discharge opening for discharging the oil to the compressor; and wherein the plate includes a mesh disposed in the oil discharge opening.

* * * * *